US010005590B2

(12) United States Patent
Gallagher

(10) Patent No.: US 10,005,590 B2
(45) Date of Patent: Jun. 26, 2018

(54) CONTAINER FOR ARTICLES

(71) Applicant: David Fleming Gallagher, Milton, MA (US)

(72) Inventor: David Fleming Gallagher, Milton, MA (US)

( * ) Notice: Subject to any disclaimer, the term of this patent is extended or adjusted under 35 U.S.C. 154(b) by 0 days. days.

(21) Appl. No.: 15/646,066

(22) Filed: Jul. 10, 2017

(65) Prior Publication Data

US 2017/0305600 A1 Oct. 26, 2017

Related U.S. Application Data

(63) Continuation of application No. 14/255,081, filed on Apr. 17, 2014, now Pat. No. 9,701,444.

(60) Provisional application No. 61/975,523, filed on Apr. 4, 2014, provisional application No. 61/937,439, filed on Feb. 7, 2014.

(51) Int. Cl.

| | |
|---|---|
| ***B65D 25/16*** | (2006.01) |
| ***A45C 13/02*** | (2006.01) |
| ***B65D 5/60*** | (2006.01) |
| *A45C 3/00* | (2006.01) |

(52) U.S. Cl.

CPC ..... *B65D 25/16* (2013.01); *A45C 13/02* (2013.01); *B65D 5/60* (2013.01); *A45C 2003/007* (2013.01)

(58) Field of Classification Search

CPC ..... A45C 3/10; A45C 13/02; A45C 2003/007; B65D 5/60; B65D 25/16; B65D 33/16; B65D 47/061; B65D 47/0809; B65D 51/002; B65D 51/24; B65D 51/26; B65D 51/28; B65D 75/58; B65D 75/5861; B65D 75/5866; B65D 85/00; B65D 85/70; B65D 85/72; B65D 85/80; B65D 2517/0049; B65D 2517/005; A61J 19/00

USPC ..... 220/521, 522; 221/64; 383/4, 36, 42, 383/904, 906

See application file for complete search history.

(56) References Cited

U.S. PATENT DOCUMENTS

| | | | | |
|---|---|---|---|---|
| 1,903,082 A * | 3/1933 | Adams | A63H 37/00 446/310 |
| 2,709,467 A * | 5/1955 | Hoeppner | B65D 33/24 383/87 |
| 3,746,215 A * | 7/1973 | Ausnit | B65D 33/00 383/36 |
| 4,311,257 A * | 1/1982 | Grieco | B65D 83/005 222/387 |
| 4,634,618 A * | 1/1987 | Greer | A47G 9/062 383/38 |

(Continued)

*Primary Examiner* — Bryon Gehman

(74) *Attorney, Agent, or Firm* — Steven N. Fox, Esq.

(57) ABSTRACT

Disclosed is a container for storing, displaying, and dispensing many types of articles. The container comprises a body comprising a cavity to store the articles and an open end for access to the articles. The container further comprises a lid comprising a cavity, a first open end engaged with the open end of the body and a flexible sheet engaged with and fully disposed within the cavity of the lid. The container further comprises a cap engaged with a second open end of the lid. Removal of the cap from the lid allows the flexible sheet to be moved between a first position where the flexible sheet is disposed outward of the lid with the articles resting on the flexible sheet and a second position where the flexible sheet is held to form a u-shaped tube allowing the articles to be poured into said second open end of the lid.

10 Claims, 10 Drawing Sheets

(56) References Cited

U.S. PATENT DOCUMENTS

| | | | | | |
|---|---|---|---|---|---|
| 4,838,327 | A * | 6/1989 | Ambler | A61F 15/003 | 383/36 |
| 5,030,013 | A * | 7/1991 | Kramer | A45C 11/22 | 383/36 |
| 5,056,932 | A * | 10/1991 | Young | A61J 19/00 | 383/36 |
| 5,067,821 | A * | 11/1991 | Young | A61F 5/44 | 383/36 |
| 5,533,653 | A * | 7/1996 | Kaufman | A45C 3/10 | 383/38 |
| 6,634,041 | B2 * | 10/2003 | Higashi | A45C 3/10 | 383/4 |
| 6,783,276 | B2 * | 8/2004 | Machacek | B65D 33/2591 | 383/36 |
| 7,686,791 | B2 * | 3/2010 | Ramage | A61J 19/00 | 229/117.03 |
| 7,947,024 | B2 * | 5/2011 | Ramage | A61J 19/00 | 604/317 |
| 2005/0139596 | A1 * | 6/2005 | Yabusaki | B65D 51/242 | 220/229 |
| 2009/0041395 | A1 * | 2/2009 | Bossel | B65D 75/008 | 383/201 |
| 2012/0228331 | A1 * | 9/2012 | MacDonald | B65D 25/48 | 222/189.07 |
| 2014/0284337 | A1 * | 9/2014 | Rafferty | B65D 51/2828 | 220/521 |

* cited by examiner

FIG. 31
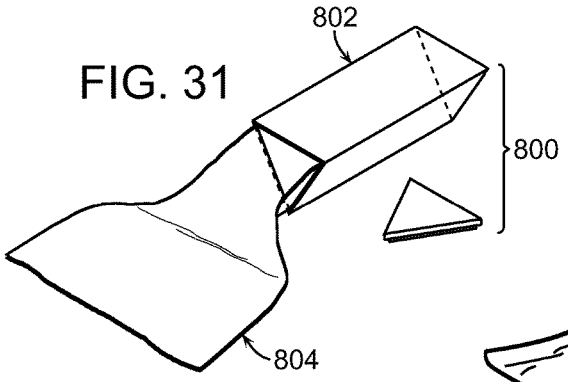
FIG. 32
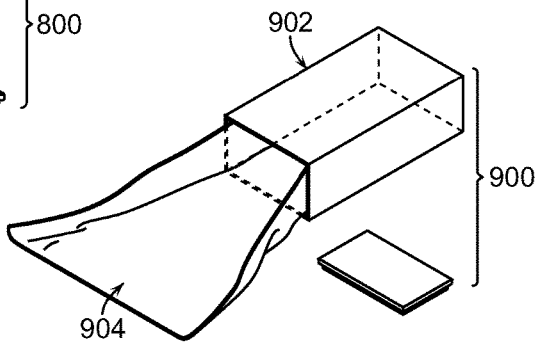
FIG. 33
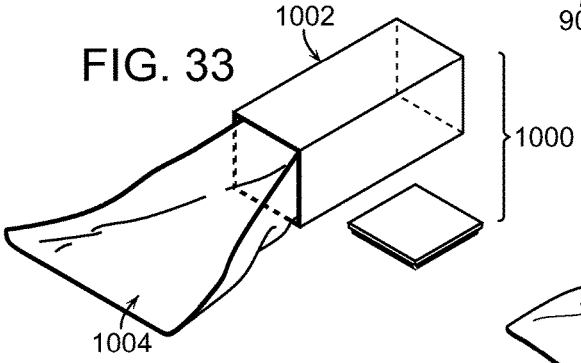
FIG. 34
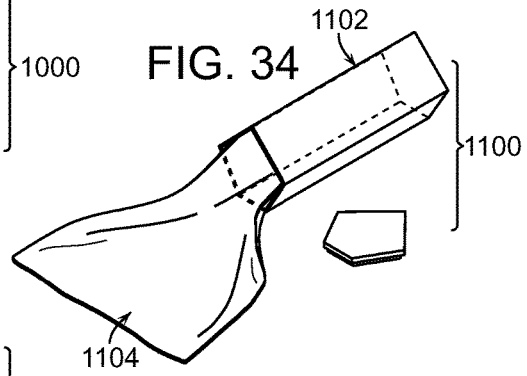
FIG. 35
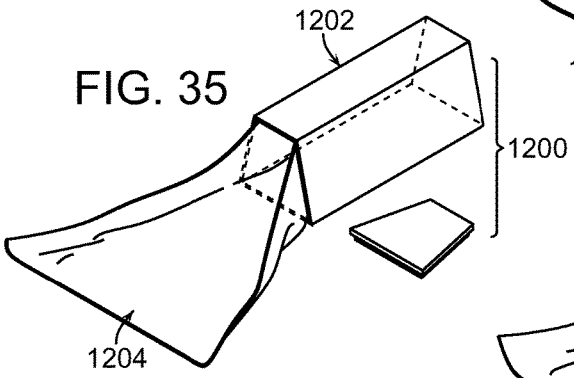
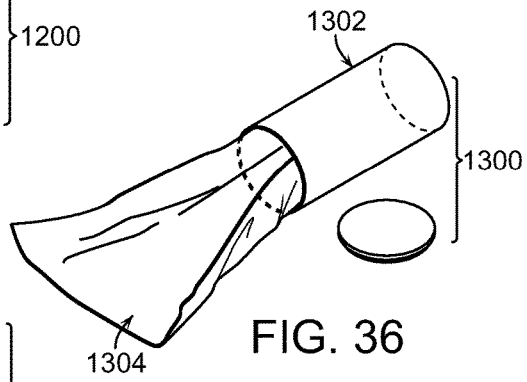
FIG. 36
FIG. 37
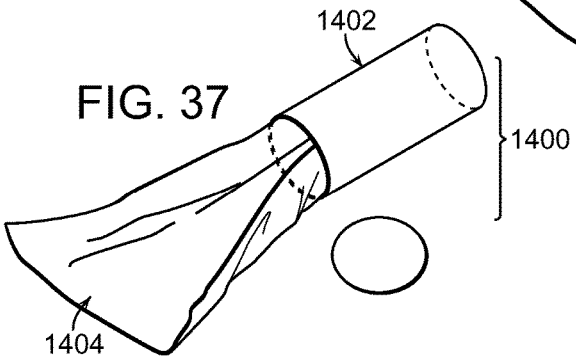

CONTAINER FOR ARTICLES

CROSS-REFERENCE TO RELATED APPLICATIONS

This application is a continuation of and claims priority to U.S. Utility application Ser. No. 14/255,081 filed on Apr. 17, 2014, which claims priority to U.S. Provisional Application Ser. No. 61/975,523 filed on Apr. 4, 2014, and U.S. Provisional Application Ser. No. 61/937,439 filed on Feb. 7, 2014, all of which are hereby incorporated into this specification by reference in their entirety.

BACKGROUND OF THE INVENTION

Containers have been used for many years to store various articles such as screws, food, clothing, and jewelry. Such conventional containers do not allow for easy dispensing or removal of the articles. Further, such conventional containers do not allow for easy filling, selection, and/or return of the articles into the container once removed.

SUMMARY OF THE INVENTION

One object of the present invention was to develop a container that would allow easy filling, removal, selection and/or return of the articles into the container.

In a first embodiment, the present invention is a container for storing, selection, and dispensing many types of articles. In one embodiment, the container comprises a body comprising a cavity to store the articles and an open end for access to the articles. The container further comprises a lid comprising a cavity, a first open end removably engaged with the open end of the body, a second open end, and a flexible sheet comprising a body portion engaged with and fully disposed within the cavity of the lid. The container further comprises a cap removably engaged with the second open end of the lid. Removal of the cap from the lid allows the flexible sheet to be moved from a first position where the flexible sheet is disposed outward of the lid and body with the articles resting on the body portion of the flexible sheet allowing the person unobstructed access to the articles disposed along the entire length of the flexible sheet, and a second position where the corners of the flexible sheet may be held to form a u-shaped tube allowing the articles to be inserted by the person into the second open end of the lid leading to the cavity of the body. The body, lid, and flexible sheet may be configured in many shapes and/or materials for different applications.

BRIEF DESCRIPTION OF THE DRAWINGS

The following description of the invention will be further understood with reference to the accompanying drawings, in which:

FIG. 31 is a perspective view of a container according to an eighth embodiment of the present invention showing a body with a triangular cross section and a flexible sheet extending therefrom;

FIG. 32 is a perspective view of a container according to a ninth embodiment of the present invention showing a body with a rectangular cross section and a flexible sheet extending therefrom;

FIG. 33 is a perspective view of a container according to a tenth embodiment of the present invention showing a body with a square cross section and a flexible sheet extending therefrom;

FIG. 34 is a perspective view of a container according to an eleventh embodiment of the present invention showing a body with a pentagon cross section and a flexible sheet extending therefrom;

FIG. 35 is a perspective view of a container according to a twelfth embodiment of the present invention showing a body with a trapezoidal cross section and a flexible sheet extending therefrom;

FIG. 36 is a perspective view of a container according to a thirteenth embodiment of the present invention showing a body with a circular cross section and a flexible sheet extending therefrom;

FIG. 37 is a perspective view of a container according to a fourteenth embodiment of the present invention showing a body with an elliptical cross section and a flexible sheet extending therefrom;

DESCRIPTION OF THE INVENTION

Figure 1:
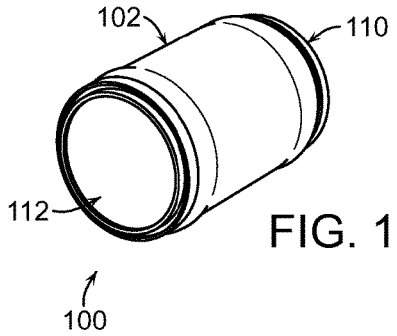
FIG. 1 is a perspective view of a first embodiment of a container according to the present invention showing a body and two end caps or lids.
Figure 2:
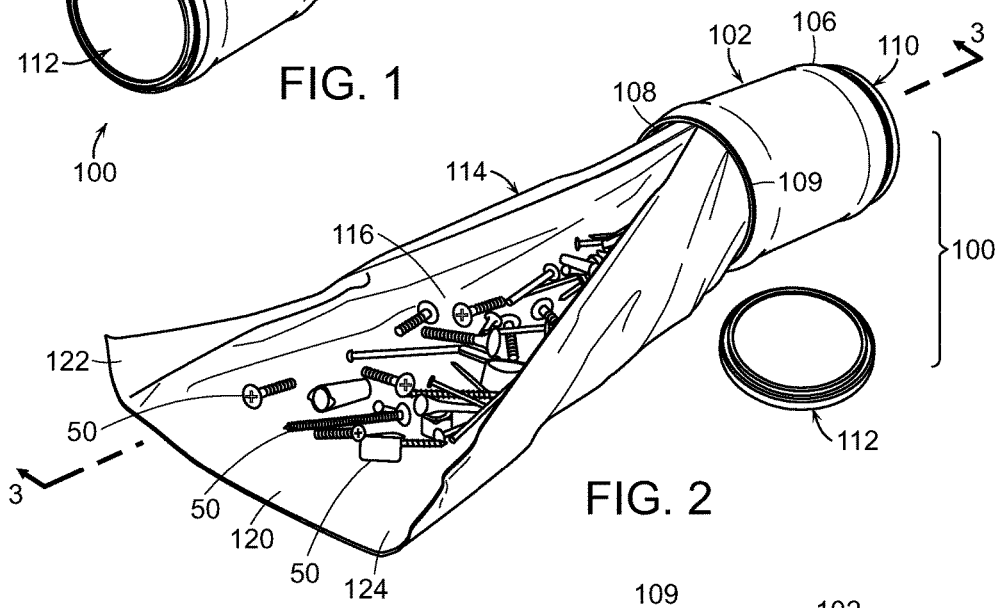
FIG. 2 is a perspective view of the container of first embodiment with one lid removed and a flexible sheet extending outward of the body with articles or hardware (such as screws, nails, etc.) disposed thereon.
Figure 3:
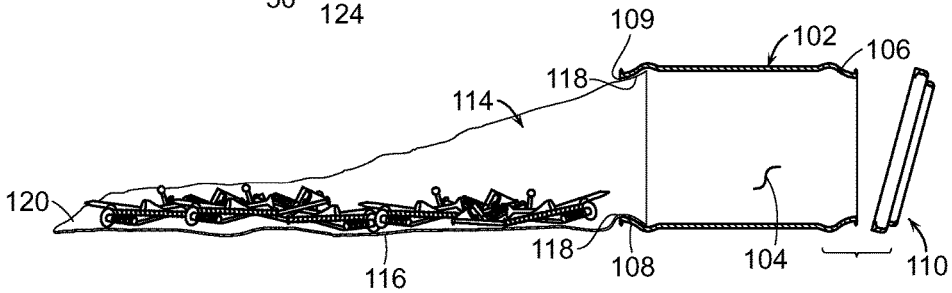
FIG. 3 is a cross section view taken along line 3-3 of FIG. 2 showing the flexible sheet connected to the annular inner end portion of the body of the container.
Figure 4:
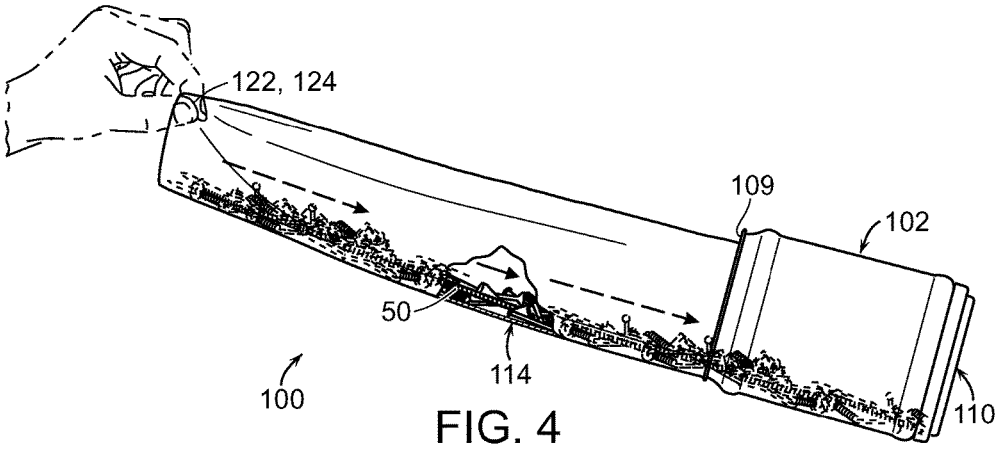
FIG. 4 is a perspective view of the container of the first embodiment showing the flexible sheet vertically lifted and/or oriented to place and/or insert the articles into the open end portion of the body of the container.
Figure 5:
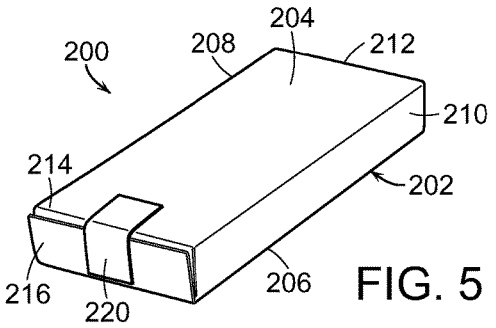
FIG. 5 is a perspective view of a second embodiment of a container according to the present invention showing a paper housing having one end that can be opened and closed by a flap to store and dispense articles such as food.

Referring to FIGS. 1-4, where a first embodiment of a container 100 according to the present invention is shown. Container 100 allows a person to easily and quickly fill and store articles 50 such as screws, bolts, nails and various other items. Container 100 further allows the person to easily and quickly remove and display articles 50 for selection by the person. Container 100 also allows the person to easily and quickly return the unselected articles for later use. Container 100 generally comprises a body 102, a first lid 110, a second lid 112, and a flexible sheet 114 disposed completely within body 102. Body 102 generally comprises a cavity 104 and first and second open end portions 106 and 108. First lid 110 is removably engaged or attached to first open end portion 106 by conventional means such as snap on mating snap on portions or threads for accessing articles 50 in a conventional manner. First lid 110 may also be used to add or fill additional articles 50 as needed. Second lid 112 is removably engaged or attached to second open end portion 108 by conventional means such as snap on portions or threads for accessing articles 50 in a conventional manner. As shown by FIG. 2, second lid 112 can be removed and articles 50 of container 100 can be shaken out onto flexible sheet 114 for viewing and selection. Flexible sheet 114 generally comprises a body portion 116, a first end portion 118, and a second end portion 120 having corners 122 and 124. Open end 108 is circular shaped and comprises a circumference 109. First end portion 118 of flexible sheet 114 is secured to more than half of circumference 109 of open end 108. Once the desired article has been selected, corners 122 and 124 of flexible sheet 114 can be pinched together and flexible sheet 114 may be stretched to form a u-shaped tube. As shown by FIG. 3, first end portion 118 of flexible sheet 114 is attached approximately 360 degrees around the inside surface of open end 108 of body 102 by an adhesive. First end portion 118 of flexible sheet 114 may be secured to the inside surface of open end 108 of body 102 by a variety of mechanical fastening means, including but not limited to, threads or a plastic ring. Similarly, flexible sheet 114 may be attached to various inner surfaces or portions of body 102. As shown by FIG. 4, corners 122 and 124 of flexible sheet 114 can be raised vertically causing flexible sheet 114 to form a u-shaped tube at an angle to the horizontal which causes articles 50 to slide back into cavity 104 of body 102. Flexible sheet 114 can be rolled up and placed inside cavity 104 of body 102, and second lid 112 can be replaced. Container 100 is useful to quickly and conveniently view the contents for selection and then easily return the contents to the container. Flexible sheet 114 spreads out the contents of container 100 upon any available flat surface such as a table. Rather than having the contents compactly stored in a conventional container where selection of individual objects is difficult, the contents are spread out on flexible sheet 114, possibly in a single layer, which exposes all objects to the observer without one object being hidden behind another. The user can then easily return the contents to container 100 for further storage. In the embodiment shown, flexible sheet 114 is made from a textile material such as cloth. However, flexible sheet 114 can be made of any type of flexible material, including but not limited to, plastic, leather and/or paper. In the embodiment shown, flexible sheet is a single piece of material. In other embodiments, flexible sheet 114 may comprise one or more pieces fastened together by conventional means each having the same or different materials. In the embodiment shown, body 102 is made from plastic. However, body 102 can be made from a variety of materials, including but not limited to, plastic, cloth, leather, paper, and or metal. In the embodiment shown, lids 110 and 112 are made from plastic. However, lids 110 and 112 may be made from a variety of materials, including but not limited to, cloth, leather, paper or metal.

Figure 6:
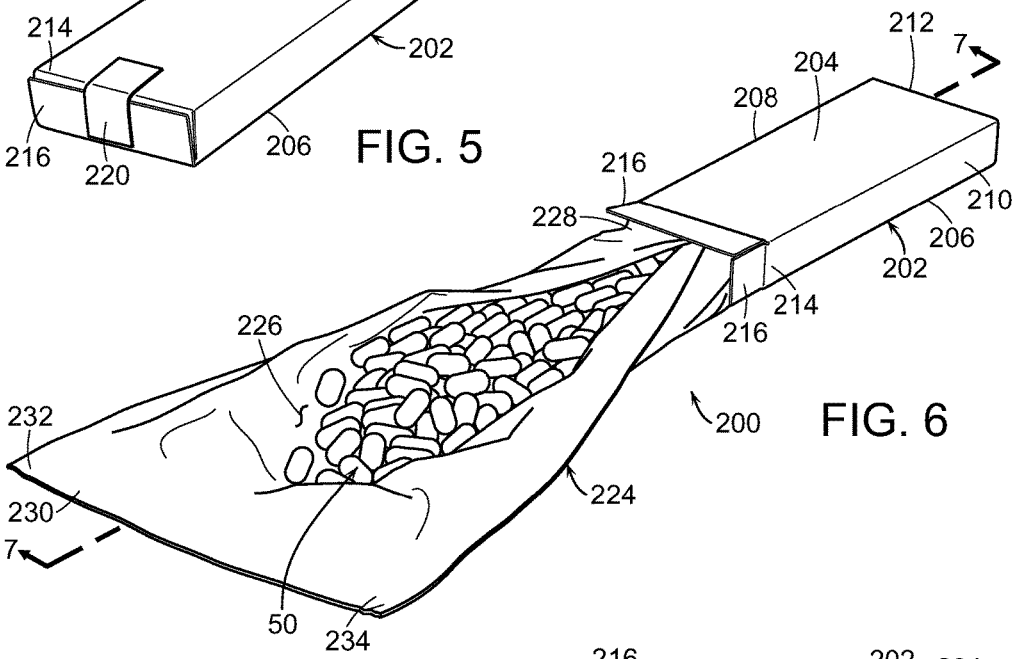
FIG. 6 is a perspective view of the container of the second embodiment showing a flexible sheet extending outward of the paper housing with articles such as food disposed thereon.
Figure 7:
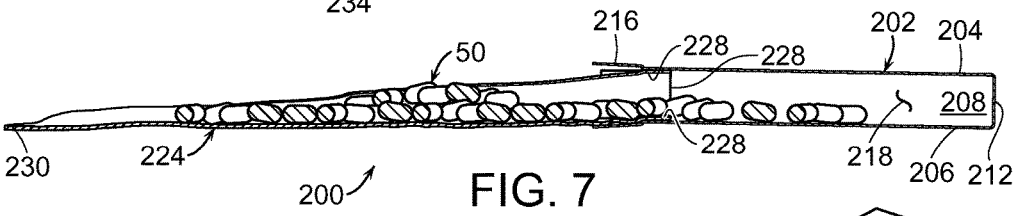
FIG. 7 is a cross section perspective view of the container of the second embodiment showing a flexible sheet extending outward of the paper housing with articles such as food disposed thereon.
Figure 8:
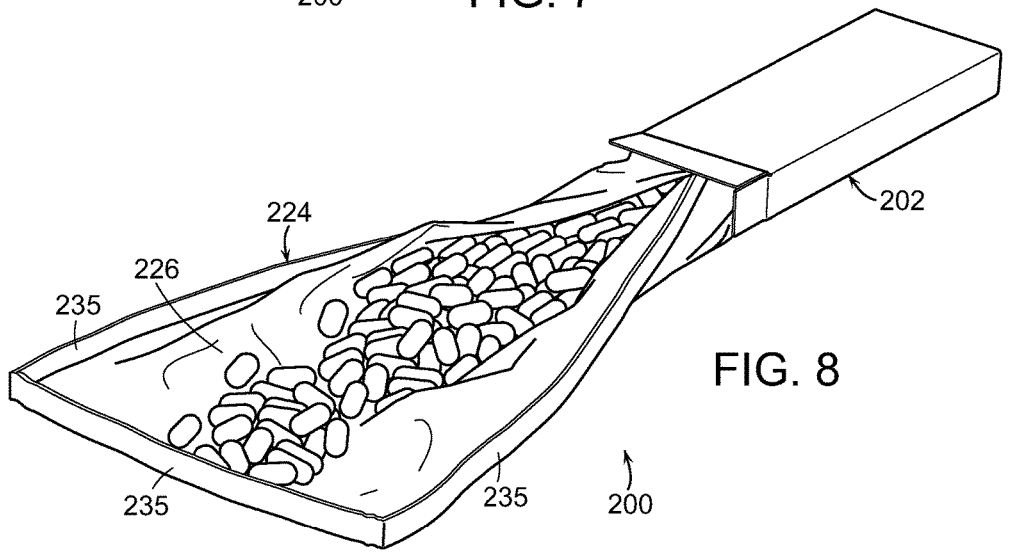
FIG. 8 is a perspective view of the container of the second embodiment showing flexible sheet having formed sidewalls to prevent articles such as food from falling off the flexible sheet.
Figure 9:
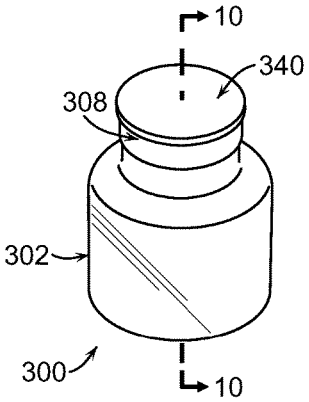
FIG. 9 is a perspective view of a container according to a third embodiment the present invention showing a body and a single lid.

Referring to FIGS. 5-8, where a container 200 according to a second embodiment of the present invention is shown. Container 200 allows a person to easily remove and display food articles 50 upon a clean surface for selection by the person and to return the unselected food articles to container 200 for later consumption. Container 200 generally comprises a body 202 and a flexible sheet 224. Body 202 generally comprises a top wall 204, a bottom wall 206, a left side wall 208, a right side wall 210, a closed end 212, an open end 214, and a plurality of end flaps 216 that can be folded to close open end 214, and a cavity 218 to store food articles 50. A fastener strip 220 is provided to removably secure end flaps 216 to body 202. Flexible sheet 224 generally comprises a body portion 226, a first end portion 228, a second end portion 230 having corners 232 and 234. First end portion 228 of flexible sheet 224 is secured to open end 216 of body 202 by conventional means such as adhesive. First end portion 228 of flexible sheet 224 can be secured to any inside portion of body 202. As shown in FIG. 6, end flaps 216 can be opened to access flexible sheet 224 and the food contents of the body 202 shaken out onto flexible sheet 224. First end portion 228 of flexible sheet 224 is secured to all four inner side surfaces of open end 214 of body 202. This almost guarantees that as the contents of body 202 are shaken out, they will land on flexible sheet 224 for viewing. A further benefit of flexible sheet 224 is that it acts like a serving tray or bowl in so far as food products go because the food product does not come in contact with the flat surface that the product is displayed on. In other words, the food does not get dirty by coming into contact with any surfaces thereby creating a healthy and safe environment for a person to select a food article. As in previous embodiments, it is a simple matter to pinch together corners 232 and 234 of flexible sheet 224 to form a tube to quickly and easily return the food contents to container 200. Flexible sheet 224 is not limited to a flat sheet shape as shown. As shown by FIG. 8, flexible sheet 224 can have an edge or border 235 around body 226 to prevent items from rolling off flexible sheet 224. Flexible sheet 224 can also be bowl shaped and may contain liquids. In the embodiment shown, flexible sheet 224 is made from paper. However, as in other embodiments, flexible sheet 224 can be made of any type of flexible material, including but not limited to, plastic, cloth, and/or leather. In the embodiment shown, body 202 is made from cardboard. However, as in other embodiments, body 202 can be made from a variety of materials, including but not limited to, plastic, cloth, leather, and/or paper.

Figure 10:
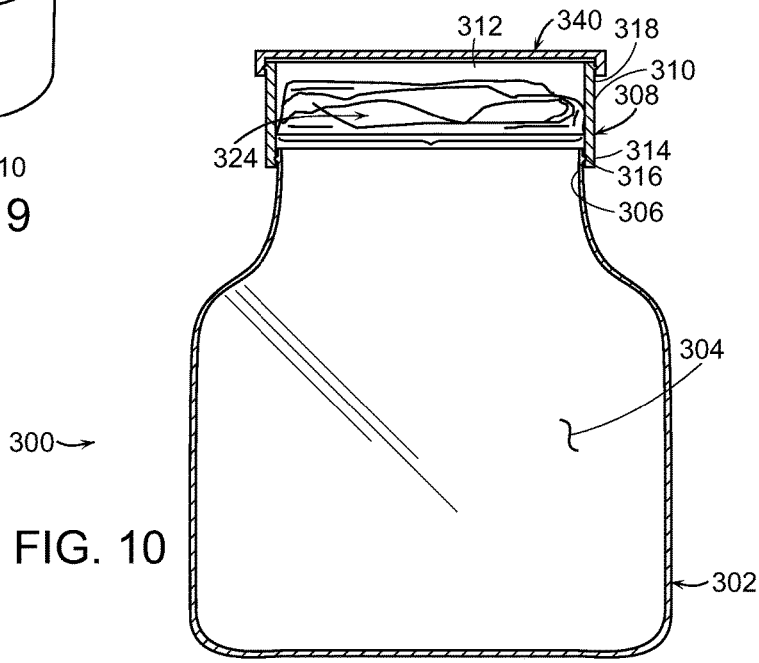
FIG. 10 is cross section view of the container of third embodiment taken along line 10-10 of FIG. 9 showing a flexible sheet disposed within the lid that is removably engaged with the open end of the body.
Figure 11:
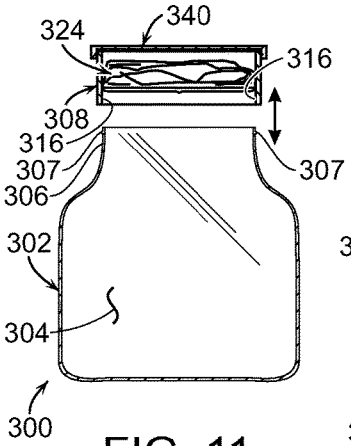
FIG. 11 is a cross section view of the container of the third embodiment showing the lid removed from the body, the flexible sheet disposed within the lid, and a removable cap on the lid.
Figure 12:
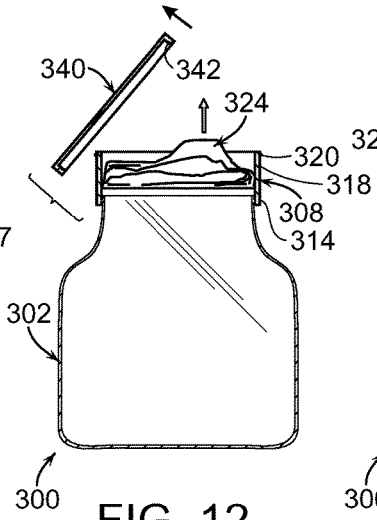
FIG. 12 is a cross section view of the container of the third embodiment showing the lid attached to the open end of the body and the cap of the lid removed allowing access to the flexible sheet.
Figure 13:
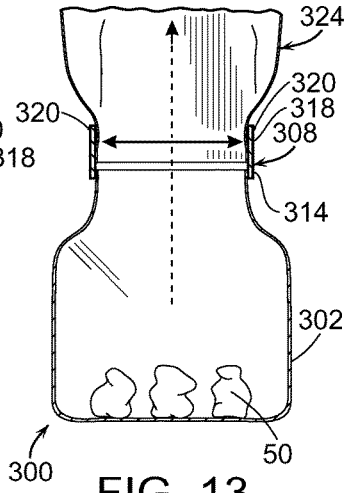
FIG. 13 is a cross section view of the container of the third embodiment showing the flexible sheet extending upward from the open end of the body and the cap of the lid removed.
Figure 14:
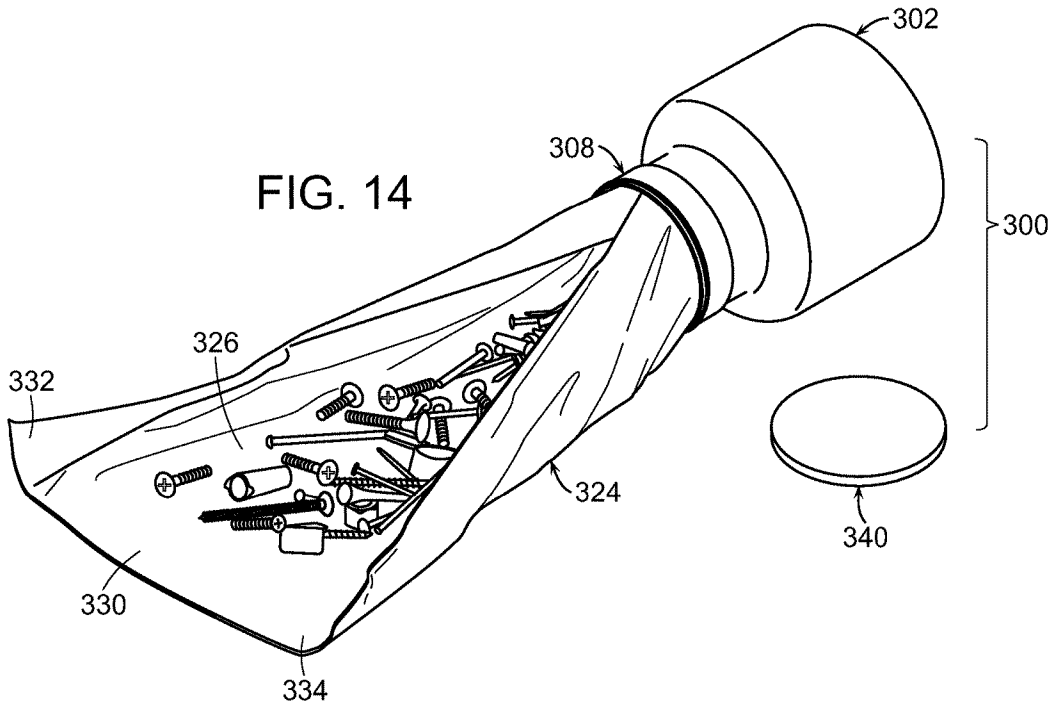
FIG. 14 is a perspective view of the container of the third embodiment showing the flexible sheet extended from the body (with articles disposed thereon) and a cap of the lid removed.
Figure 15:
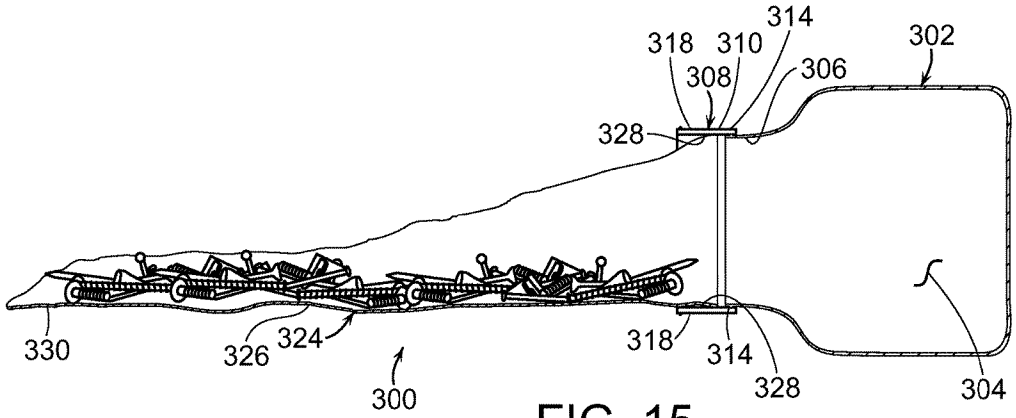
FIG. 15 is a cross section view of the container of the third embodiment showing the flexible sheet extended from the body and articles disposes thereon.

Referring to FIGS. 9-15, where a container 300 according to a third embodiment of the present invention is shown. Container 300 comprises a body 302, a lid 308, a flexible sheet 324 disposed within lid 308, and a cap 340 providing access to flexible sheet 324. Body 302 comprises a cavity 304 and an open end 306 having an annular lip 307. Lid 308 comprises a body 310, a cavity 312, a lower end 314 having an internal annular recess 316, and an upper end 318 having an external annular lip 320. Annular recess 316 of lower end 314 of lid 308 removably engages with or snaps into annular external lip 307 of body 302. Similarly, annular lip 320 of upper end 318 of lid 308 removably engages with or snaps into internal annular recess 342 of cap 340. Flexible sheet 324 comprises a body portion 326, a first end portion 328, and a second end portion 330 having corners 332 and 334. First end portion 328 of flexible sheet 324 is secured to the inner portion of lower end 314 of body 310 by conventional means such as adhesive. Cap 340 comprises an internal annular recess 342 that engages or snap fits with external annular lip 320 of upper end 318 of body 302. As shown by FIG. 10, lid 308 fully stores and contains flexible sheet 324 inside it allowing body 302 of container 300 to be used conventionally to store articles 50. As shown by FIG. 11, lid 308 can be taken on and off without using flexible sheet 324. As shown by FIG. 12, should it be decided by the user to use flexible sheet 324, the user simply removes cap 340 and pulls out flexible sheet 324. As shown by FIG. 13, removal of flexible sheet 324 allows the articles 50 stored in body 302 of container 300 to be poured through body 310 of attached lid 308 on to flexible sheet 324. As in other embodiments, the articles 50 can be returned to body 302 of container 304 by pulling corners 332 and 334 of flexible sheet 324 to form a u-shaped tube and tilting the formed u-shaped tube to return the articles 50 to body 302. After using flexible sheet 324 and it is desired to return it to lid 308 for storage until the next use, body portion 326 of flexible sheet 324 is twisted 360 degrees near lower end 314 of body 310 of lid 308 and inserted back into lid 308 and cap 340 is put in place. The 360 degree twist prevents flexible sheet 324 from falling into body 302 of container 300. In the embodiment shown, flexible sheet 324 is made from a textile material such as cloth. However, as in other embodiments, flexible sheet 324 can be made of any type of flexible material, including but not limited to, plastic, leather, and/or paper. In the embodiment shown, body 302 is made from plastic. However, as in other embodiments, body 302 can be made from a variety of materials, including but not limited to, glass, cloth, leather, paper, and/or metal. In the embodiment shown, lid 308 and cap 340 are made from plastic. However, lid 308 and cap 340 may be made from a variety of materials, including but not limited to, metal. In other embodiments, lid 308 could be formed as part of body 302.

Figure 17:
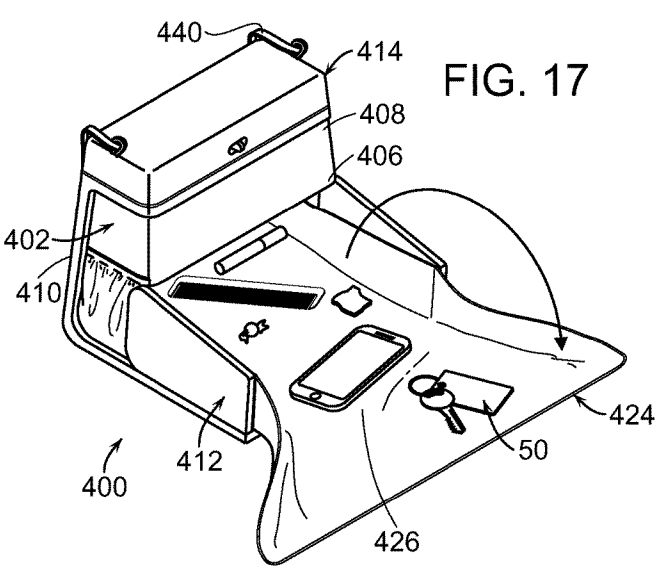
FIG. 17 is a perspective view of the container of the fourth embodiment showing a flexible sheet extending outward from the front flap and articles disposed thereon.
Figure 16:
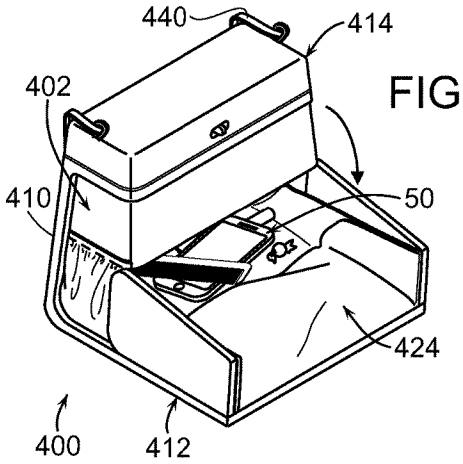
FIG. 16 is a perspective view of a container according to a fourth embodiment of the present invention showing a purse or bag having a body, an upper flap, and a lower flap, and a flexible sheet engaged with the body and extending outward of the body and lower flap and articles disposed on the flexible sheet.
Figure 19:
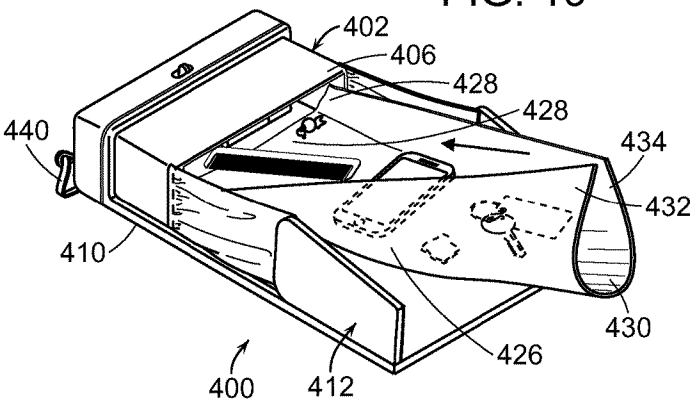
FIG. 19 is a perspective view of the container of the fourth embodiment showing the body orientated horizontally and the flexible sheet pulled or oriented vertically to pour, slide and/or insert the articles into the upper cavity of the body.
Figure 18:
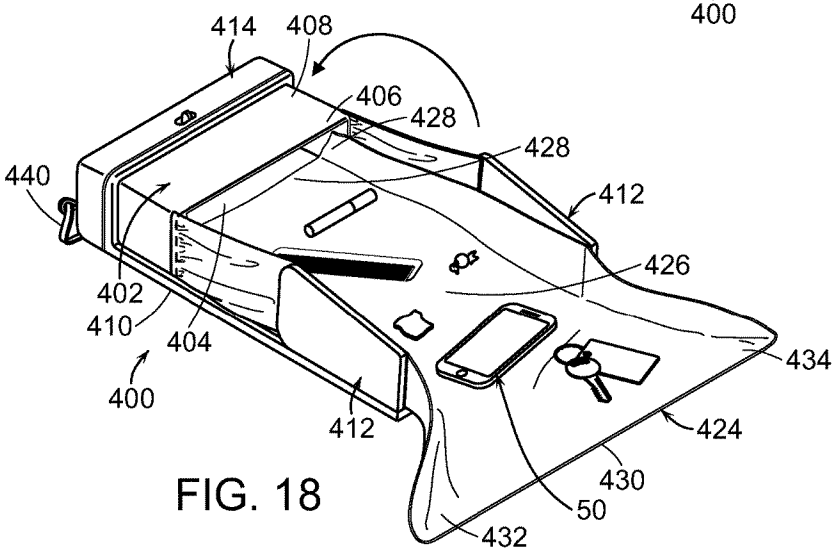
FIG. 18 is a perspective view of the container of the fourth embodiment showing the body orientated horizontally exposing the upper cavity and the flexible sheet extending outward from the upper cavity with articles disposed thereon.
Figure 20:
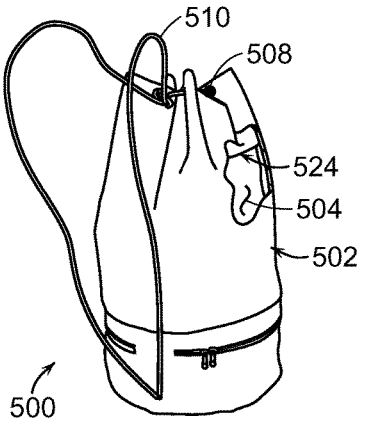
FIG. 20 is a perspective view of a container of a fifth embodiment of the present invention showing a tote or canvas utility bag having a body with an upper end that is closed by pulling a string or rope, and a flexible sheet disposed therein.
Figure 21:
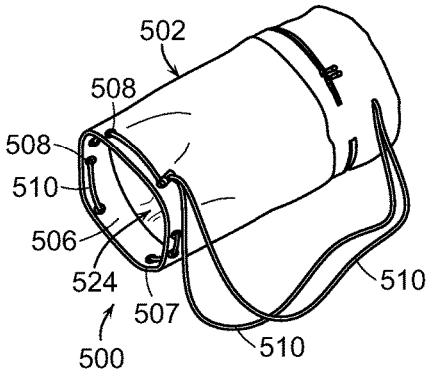
FIG. 21 is a perspective view the container of the fifth embodiment showing the upper end of the utility bag open with the flexible sheet disposed therein.
Figure 22:
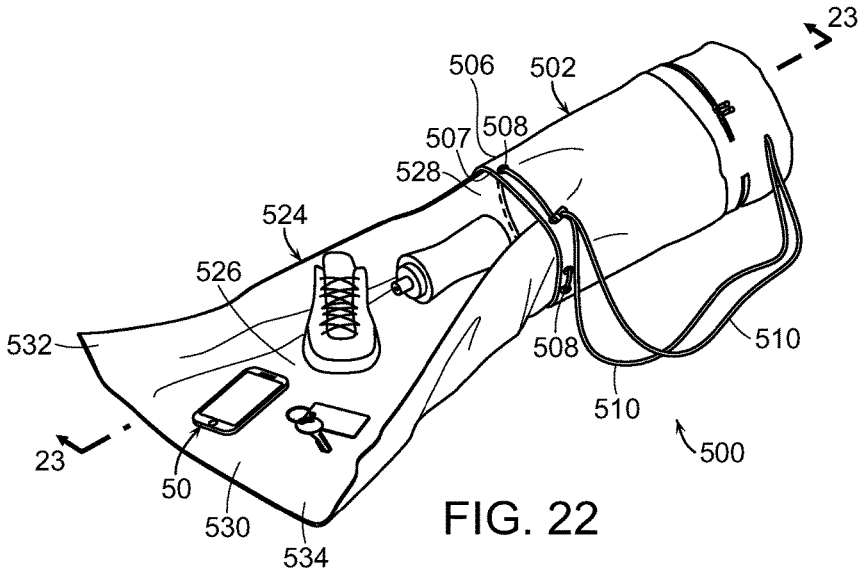
FIG. 22 is a perspective view of the container of the fifth embodiment showing the flexible sheet extending from the open end of the utility bag with articles disposed thereon.
Figure 23:
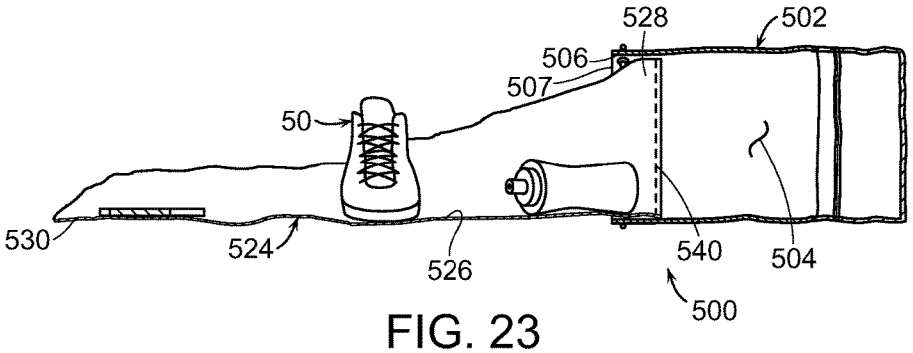
FIG. 23 is a cross section view of the container of the fifth embodiment along line 23-23 of FIG. 22 showing the flexible sheet secured to inner portion of the upper end of the utility bag.

Referring to FIGS. 16-19, where a container 400 according to a fourth embodiment of the present invention is shown. In this embodiment, container 400 is a woman's handbag or on a smaller scale, a change purse. Container 400 generally comprises a body 402 having a cavity 404, a lower open end 406, an upper open end 408, and a flexible sheet 424 engaged with the inner surface of lower open end 406 between a stored and extended position. Container 400 further comprises a wall 410, a lower flap 412, and an upper flap 414. Flexible sheet 424 generally comprises a body portion 426, a first end portion 428, and a second end portion 430 having corners 432 and 434. Upper flap 410 is a conventional snap type closure allowing conventional use of the handbag or container 400. As shown by FIG. 16, should it be desired to locate an item, lower flap 412 can be opened. As shown by FIG. 17, flexible sheet 424 can be pulled out and rested upon a surface such as a table. The handbag or container 400 can then be tilted to move the contents of the interior of the handbag on to flexible sheet 424 for inspection. As shown by FIG. 18, if it is desired to expand the size of flexible sheet 424 to better show the contents, this can be accomplished by rotating the handbag back so wall 410 of body 402 lies flat upon the same surface as lower flap 412 of body 402. As in previous embodiments, after the desired item is found, the items can be returned to the purse by pinching and lifting corners 432 and 434 of flexible sheet 424 into a tube and sliding the contents back into body 402 of container 400. Container 400 further comprises a handle 440 that is the embodiment shown is a rope or string. In the embodiment shown, flexible sheet 424 is made from a textile material such as cloth. However, as in other embodiments, flexible sheet 424 can be made of any type of flexible material, including but not limited to, plastic, leather, and/or paper. In the embodiment shown, body 402 is made from plastic. However, as in other embodiments, body 402 can be made from a variety of materials, including but not limited to, cloth, leather, and/or paper.

Referring to FIGS. 20-23, where a container 500 according to a fifth embodiment of the present invention is shown. In this embodiment, container 500 is a tote or utility bag comprising a body 502 and a flexible sheet 524 engaged with body 502. Body 502 comprises a cavity 504 to store articles 50, an open end 506, and a plurality of holes 508 evenly spaced about open end 506. Container 502 further comprises a rope 510 passing thru holes 508. Pulling of rope 510 closes open end 506 of body 502. Open end 506 can be manually re-opened by release of rope 510. Flexible sheet 524 generally comprises a body portion 526, a first end portion 528, and a second end portion 530 having corners 532 and 534. First end portion 528 of flexible sheet 524 is secured to the inner surface of open end 506 by conventional means such as threads 540. Open end 506 is circular shaped and comprises a circumference 507. First end portion 528 of flexible sheet 524 is secured to more than half of circumference 507 of open end 506. First end portion 528 of flexible sheet 524 may be secured to the inner surface of open end 506 by a variety of conventional means such as adhesive. Flexible sheet 524 can be pulled out and rested upon a surface such as a table, a floor, a lawn or a beach. Container 500 can then be tilted to move the contents of the interior of container 500 on to flexible sheet 524 for inspection. As in previous embodiments, after the desired item is found, the items can be returned to body 502 of container 500 by pinching and lifting corners 532 and 534 of flexible sheet 524 to form a u-shaped tube and sliding articles 50 back into body 502. In the embodiment shown, flexible sheet 524 is made from a textile material such as cloth. However, as in other embodiments, flexible sheet 524 can be made of any type of flexible material, including but not limited to, plastic, leather, and/or paper. In the embodiment shown, body 502 is made from of a textile material such as canvas. However, as in other embodiments, body 502 can be made from a variety of materials, including but not limited to, cloth, leather, and/or paper.

Figure 24:
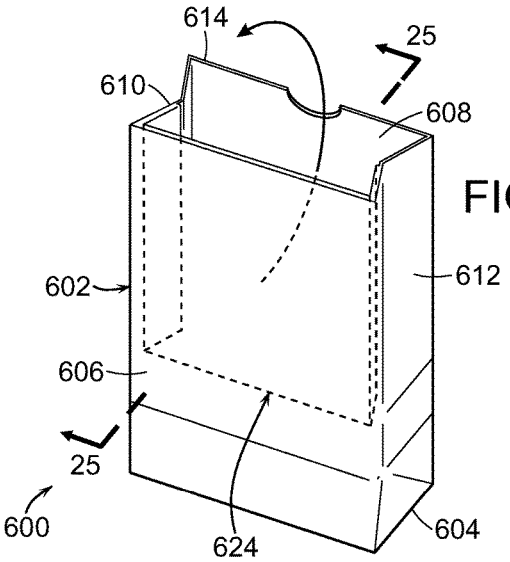
FIG. 24 is a perspective view of a container of a sixth embodiment of the present invention showing a paper bag having a body and a flexible paper sheet folded inside along the long side of the bag that may be used, for example, by a fast food restaurant to deliver food items to a customer.
Figure 25:
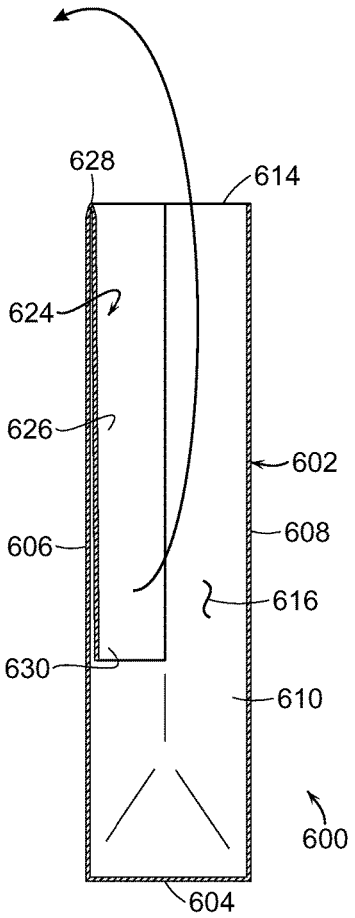
FIG. 25 is a cross section view of the container of the sixth embodiment along line 25-25 of FIG. 24 showing the flexible sheet folded within the paper bag.
Figure 26:
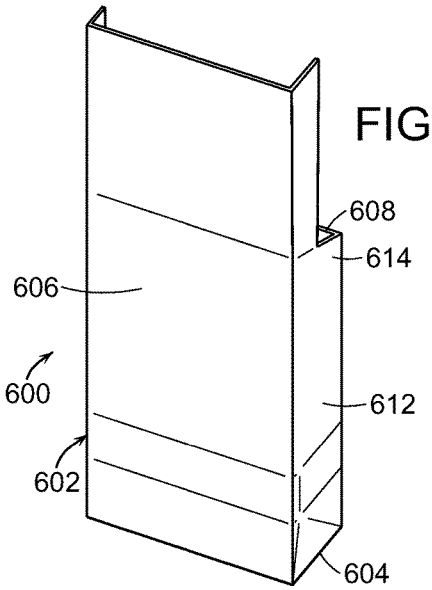
FIG. 26 is a rear perspective side view of the container of the sixth embodiment showing the paper bag vertically disposed and flexible sheet unfolded and extending outside the paper bag.
Figure 27:
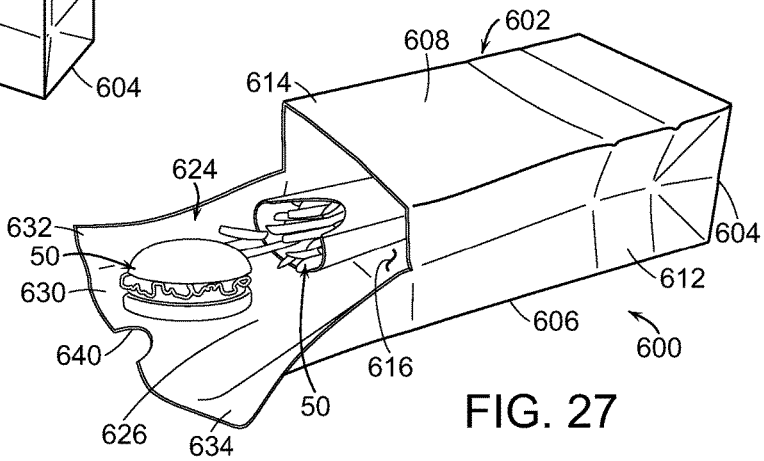
FIG. 27 is a front perspective view of the container of the sixth embodiment showing the paper bag horizontally disposed with the flexible sheet unfolded and extending outside the paper bag with food items thereon.

Referring to FIGS. 24-27, where a container 600 according to a sixth embodiment of the present invention is shown. In this embodiment container 600 is a paper bag provided by the fast food industry to serve food articles 50 in a clean or sanitary manner. Container 600 generally comprises a body 602 and a flexible sheet 624 extending outward from body 602 to provide a clean serving platform for food articles 50. Body 602 generally comprises a base 604, a left sidewall 606, a right sidewall 608, a left end wall 610, a right end wall 612, an open end 614, and a cavity 616, and a flexible sheet 624 moveable between a first position where flexible sheet 624 is disposed within cavity 616 and a second position where flexible sheet 624 is disposed outward of cavity 616. Flexible sheet 624 generally comprises a body portion 626, a first end portion 628, a second end portion 630 having corner portions 632 and 634. Flexible sheet 624 may further comprise a cut-out 640 to assist the person in gripping second end portion 630 to pull flexible sheet 624 out of the body 602. In the embodiment shown, flexible sheet 624 is integral with body 602, namely, base 604, left sidewall 606, right sidewall 608, left end wall 610, right end wall 612 and flexible sheet 624 are made from a single piece of paper. As shown in FIG. 24, flexible sheet 624 is folded inside the food bag or container 600 with the three sides of flexible sheet 624 substantially hugging the interior of body 602. As shown by FIGS. 25 and 26, once the user has received their bag or container 600 with food items 50 inside, they can activate flexible sheet 624, if desired, by grabbing flexible sheet 624 and pulling it out of cavity 614 of body 602. As shown by FIG. 27, the user can then rotate the bag 90 degrees until flexible sheet 624 contacts a horizontal surface and the bottom of the bag can be raised vertically causing food articles 50 stored in cavity 616 of body 602 to fall on to flexible sheet 624. Flexible sheet 624 provides a clean eating surface to the user should available horizontal surfaces be unclean. After the meal is complete, the user can use flexible sheet 624 to easily move the food items remains back into cavity 616 of body 602 for disposal. Specifically, although not shown, and as in described in connection with other embodiments, the food items can be returned to body 602 of container 600 by pinching and lifting corners 632 and 634 of flexible sheet 624 into a tube and sliding the contents back into body 602. In the embodiment shown, body 602 is made from a single piece of paper. However, body 602 can be made from a variety of different materials, including but not limited to, cardboard and/or cloth. In other embodiments, flexible sheet 624 can be attached to the inner surface of open end 614 of body 602 by conventional means such as adhesive. This would allow flexible sheet 624 and body 602 to be made from different materials. In all embodiments, flexible sheet 624 can be imprinted with ornamental designs, advertisements or other indicia, including but not limited to a hidden food prize.

Figure 28:
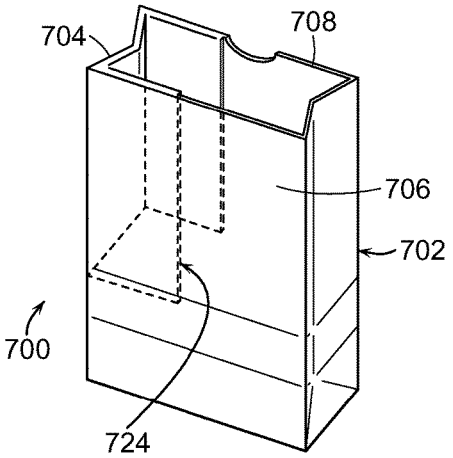
FIG. 28 is a perspective view of a container of a seventh embodiment of the present invention showing a paper bag having a body and a flexible paper sheet folded inside along the short side of the bag.
Figure 29:
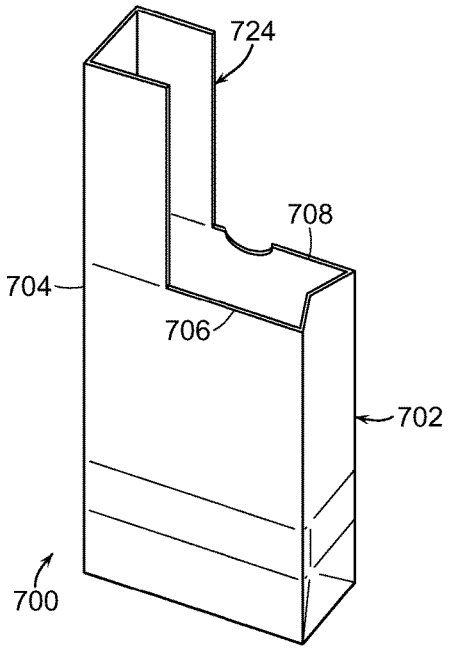
FIG. 29 is a perspective view of the container of the seventh embodiment showing the paper bag vertically disposed and the flexible paper sheet unfolded and extending outward from the paper bag.
Figure 30:
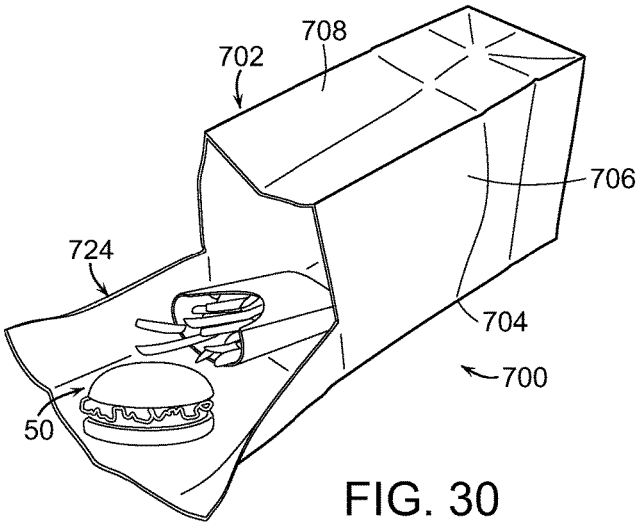
FIG. 30 is a perspective view of the container of the seventh embodiment showing the paper bag horizontally disposed and the flexible sheet unfolded and extending outward from the paper bag.

Referring to FIGS. 28-30, where a container 700 according to a seventh embodiment of the present invention is shown. Like container 600, container 700 is a paper bag for use by the fast food industry to serve food items 50. Container 700 is identical to container 600 except that flexible sheet 724 extends from a shorter end wall 704 of body 702 rather than a larger left sidewall 706 or right sidewall 708 of body 702.

Referring to FIGS. 31-37, where containers having different body shapes are shown. FIG. 31 shows a body 802 having a triangular cross section and a flexible sheet 804. FIG. 32 shows a body 902 having a rectangular cross section and a flexible sheet 904. FIG. 33 shows a body 1002 having a square cross section and a flexible sheet 1004. FIG. 34 shows a body 1102 having a pentagon cross section and a flexible sheet 1104. FIG. 35 shows a body 1202 having a trapezoidal cross section and a flexible sheet 1204. FIG. 36 shows a body 1302 having a circular cross section and a flexible sheet 1304. FIG. 37 shows a body 1402 having an elliptical cross section and a flexible sheet 1404.

There are many uses for the containers shown in FIGS. 31-37. For example, one possible use of the flexible sheet that could use all of the cross sectional shapes would be for a pill container for medicine. When the time came to take a pill, the pills could be accessed via the flexible sheet. This would prevent the pills from being shaken out onto an unclean surface as is typically done. This type of pill container would also be advantageous for a person that takes more than one type of pill. Another use could be for a jewelry container where the jewelry could be stored for easy access. Depending on the size of the jewelry, various sizes of containers could be used to hold necklaces, earrings, rings, or even cut diamonds. Another use for these types of containers could be to hold hardware items such as nuts, bolts, screws, drill bits, and washers.

Figure 38:
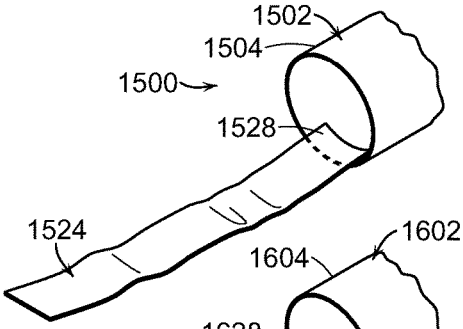
FIG. 38 is a perspective view of a container according to a fifteenth embodiment of the present invention showing a flexible sheet attached to about ¼ of an open end of a body.
Figure 39:
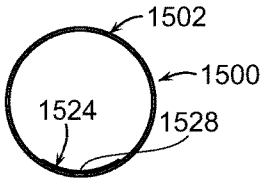
FIG. 39 is a cross section view of the container of the fifteenth embodiment showing the flexible sheet secured to about ¼ of the open end of the body.
Figure 40:
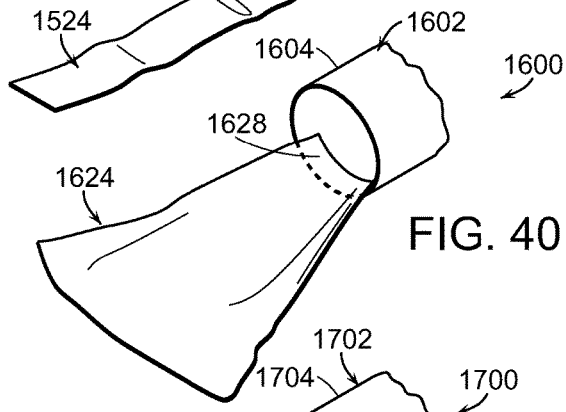
FIG. 40 is a perspective view of a container according to a sixteenth embodiment of the present invention showing a flexible sheet attached to about ⅓ of an open end of a body.
Figure 41:
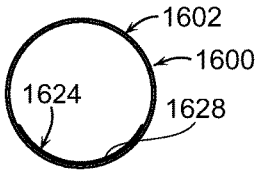
FIG. 41 is a cross section view of the container of the sixteenth embodiment showing the flexible sheet attached to about ⅓ of the open end of the body.
Figure 42:
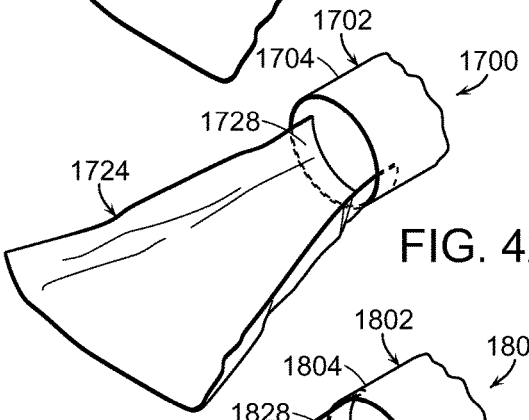
FIG. 42 is a perspective view of a container according to a seventeenth embodiment of the present invention showing a flexible sheet attached to about ½ of an open end of a body.
Figure 43:
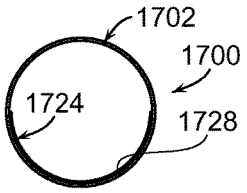
FIG. 43 is a cross section view of the container of the seventeenth embodiment showing the flexible sheet attached to about ½ of the open end of the body.
Figure 44:
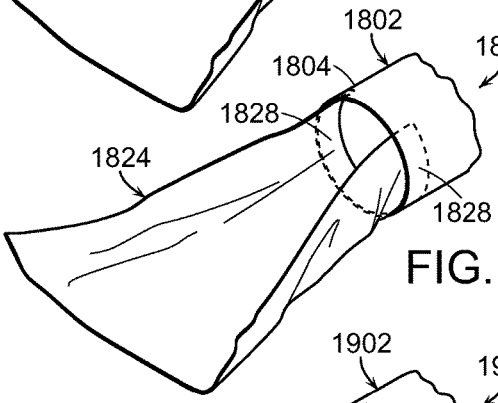
FIG. 44 is a perspective view of a container according to of a eighteenth embodiment pf the present invention showing a flexible sheet attached to about ¾ of the open end of the body.
Figure 45:
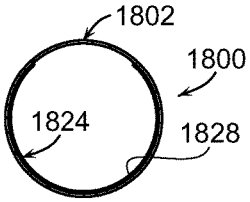
FIG. 45 is a cross section view of the container of the eighteenth embodiment showing the flexible sheet attached to about ¾ of the open end of the body.
Figure 46:
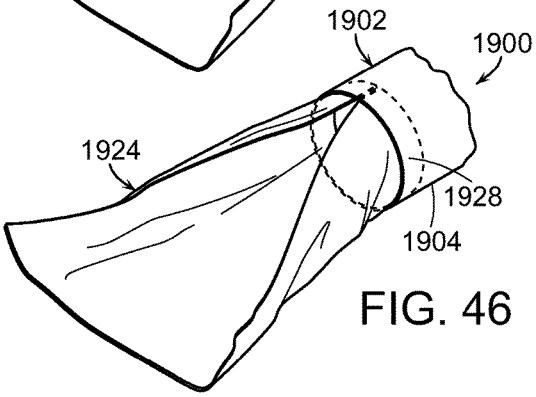
FIG. 46 is a perspective view of a container according to a nineteenth embodiment of the present invention showing a flexible sheet attached to substantially an entire open end of a body.
Figure 47:
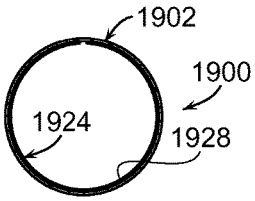
FIG. 47 is a cross section view of the container of the nineteenth embodiment showing the flexible sheet attached to substantially the entire open end of the body.

FIGS. 38-47 show that flexible sheet may be attached to the entire circumference of the inner surface of an open end of a body of a container or smaller portions thereof. For example, FIGS. 38 and 39 show flexible sheet 1524 comprising a first end 1528 secured to about one-quarter (¼) of the circumference of the inner surface of open end 1504 of body 1502. FIGS. 40 and 41 show flexible sheet 1624 comprising a first end 1628 secured to about one-third (⅓) of the circumference of the inner surface of open end 1604 of body 1602. FIGS. 42 and 43 show flexible sheet 1724 comprising a first end 1728 attached to about one-half (½) of the inner surface of open end 1704 of body 1702. FIGS. 44 and 45 show flexible sheet 1824 comprising a first end 1828 attached to about three-quarters (¾) of the inner surface of open end 1804 of body 1802. FIGS. 46 and 47 illustrate flexible sheet 1924 comprising a first end 1928 attached to substantially the entire inner surface of open end 1904 of body 1902.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A container for storing, displaying, and dispensing a plurality of articles by a person comprising:

a body comprising a cavity to store the articles and an open end for access to the articles;

a lid comprising a cavity, a first open end removably engaged with said open end of said body, a second open end, and a flexible sheet comprising corners and a body portion engaged with and fully disposed within said cavity of said lid;

a cap removably engaged with said second open end of said lid; and removal of said cap from said lid allows said flexible sheet to be moved between a first position where said flexible sheet is disposed outward of said lid and said body with the articles resting on said body portion of said flexible sheet allowing the person unobstructed access to the articles disposed along the entire length of said body portion of said flexible sheet, and a second position where said corners of said flexible sheet may be held to form a u-shaped tube allowing the articles to be inserted by the person into said second open end of said lid leading to said open end of said body.

2. The container of claim 1, wherein said body portion of said flexible sheet is twisted when disposed within said cavity of said lid to prevent said flexible sheet from entering said cavity of said body.

3. The container of claim 2, wherein said open end of said body comprises a lip portion and said first open end of said lid comprises a recessed portion that is engageable with said lip portion of said open end of said body.

4. The container of claim 3, wherein said second open end of said lid comprises a recessed portion and said cap comprises a lip portion that is engageable with said recessed portion of said second open end of said lid.

5. The container of claim 1, wherein said body is made from plastic.

6. The container of claim 1, wherein said flexible sheet is made from plastic.

7. The container of claim 1, wherein said lid is made from plastic.

8. The container of claim 1, wherein said cap is made from plastic.

9. The container of claim 1, wherein said first and second open ends of said lid are circular shaped.

10. The container of claim 1, wherein said open end of said body is circular shaped.

* * * * *